US007097509B2

(12) United States Patent
Newton, Jr. et al.

(10) Patent No.: US 7,097,509 B2
(45) Date of Patent: Aug. 29, 2006

(54) FILTERED TERMINAL BLOCK ASSEMBLY

(75) Inventors: Robert Lewis Newton, Jr., Elgin, IL (US); Robert Paul Schodt, Sr., Corry, PA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/830,382

(22) Filed: Apr. 22, 2004

(65) Prior Publication Data

US 2005/0239318 A1 Oct. 27, 2005

(51) Int. Cl.
*H01R 33/945* (2006.01)

(52) U.S. Cl. ..... 439/620; 439/908

(58) Field of Classification Search ..... 439/620 I, 439/709, 797, 908 X
See application file for complete search history.

(56) References Cited

U.S. PATENT DOCUMENTS 3,763,460 A 10/1973 Hatscheck et al.
4,995,834 A 2/1991 Hasegawa
5,046,968 A 9/1991 Baur et al.
5,181,864 A 1/1993 Wakino et al.
5,213,522 A 5/1993 Kojima
5,562,477 A 10/1996 Moore et al.
5,639,268 A * 6/1997 Julian et al. ..... 439/737
5,701,665 A 12/1997 Kling
5,895,293 A 4/1999 Brandberg et al.
5,964,625 A * 10/1999 Farley ..... 439/817
5,989,073 A * 11/1999 Kahoun ..... 439/709
6,033,269 A * 3/2000 Sekido et al. ..... 439/801
6,059,608 A 5/2000 Benes
6,065,992 A 5/2000 Wu et al.
6,238,234 B1 * 5/2001 Sedlecky ..... 439/412
6,371,791 B1 * 4/2002 Newton, Jr. ..... 439/383
6,816,033 B1 * 11/2004 Richarte et al. ..... 333/182

* cited by examiner

*Primary Examiner*—Thanh-Tam Le
(74) *Attorney, Agent, or Firm*—Armstrong Teasdale LLP

(57) ABSTRACT

A terminal block assembly includes a base assembly including a terminal block housing and a terminal stud extending through the terminal block housing. A filter assembly is coupled to one end of the stud, and a second housing is coupled to the terminal block housing over the filter assembly. The filter assembly is enclosed between the first and second housing, and a ground plate is coupled to the base assembly and the filter assembly for dissipating filtered signals.

22 Claims, 2 Drawing Sheets

FILTERED TERMINAL BLOCK ASSEMBLY

BACKGROUND OF THE INVENTION

This invention relates generally to terminal block assemblies for electrical power distribution, and, more particularly, to filtered terminal block assemblies for removing undesirable frequencies from electronic signals.

A growing proliferation of electronic devices in modern products and systems can produce unintended and undesirable signal distortion between electrical components, systems and subsystems. While some signal distortion is tolerable in many instances, in certain applications signal distortion is a significant issue that must be controlled, if not overcome. Such applications wherein reduction and/or elimination of signal distortion is desirable include, for example, power supply systems for telecommunication systems, telecommunication switching applications, cellular base stations, radar transmission systems, industrial control systems, and instrumentation systems.

Consequently, a variety of terminal block assemblies have been introduced that include one or more filter elements coupled to electrical terminal elements for removing undesirable frequency transmission through the terminal block. One type of filtered terminal block assembly includes a tubular capacitor element mounted to a terminal stud for filtering a signal through the stud. When electrical connections are made to the terminal stud in the field, however, the tubular capacitor element may be placed under a structural load. Connections to threaded studs render this type of terminal block assembly particularly vulnerable to placing the capacitor element under stress when a wire is fastened to the stud. The resultant stress may damage the capacitor element and adversely affect filtering performance of the terminal block assembly.

U.S. Pat. No. 6,371,791 discloses a terminal block assembly having a filter assembly with a tubular capacitor filtering element for filtering a signal through the stud. The filter assembly is mechanically isolated from a base assembly with a resilient contact element extending longitudinally between the terminal stud and the filter assembly. Structural loading of the filter assembly when electrical connections are made to the terminal stud is therefore avoided and reliable filtering of signals is ensured in a cost effective manner. Such terminal blocks, however, are presently limited to approximately 10,000 pF (picofarads) of capacitance. Higher capacitance levels are desired for certain applications to improve attenuation characteristics of the terminal blocks.

At least one type of terminal block exists which is capable of providing capacitance levels of about 2 μF (microfarads) using laminated foil materials to fabricate capacitive elements for filtering of signals passing through the terminal block. The manufacture of such terminal blocks, however, is difficult and equipment intensive. It would be desirable to provide a lower cost alternative terminal block which is capable of providing capacitance levels in the range of about 2 μF.

BRIEF DESCRIPTION OF THE INVENTION

According to an exemplary embodiment, a terminal block assembly is provided. The terminal block assembly comprises a base assembly comprising a terminal block housing and a terminal stud extending through the terminal block housing. A filter assembly is coupled to one end of the stud, and a second housing is coupled to the terminal block housing over the filter assembly. The filter assembly is enclosed between the first and second housing, and a ground plate is coupled to the base assembly and the filter assembly for dissipating filtered signals.

According to another exemplary embodiment, a terminal block assembly comprises a terminal block housing, at least one terminal stud extending through the terminal block housing and a filter assembly coupled to the at least one stud. The filter assembly comprises at least two filtering elements, and at least one of the filtering elements is a discoidal capacitor. A first and second resilient contact element is attached to a respective one of opposite ends of the filter assembly, and each of the first and second contact elements is electrically coupled to a respective one of the filter elements and to the at least one terminal stud. The first and second contact elements mechanically isolate the filter element from structural stress.

According to still another exemplary embodiment, a terminal block assembly is provided which comprises a terminal block housing and a plurality of terminal studs extending through the terminal block housing. A filter assembly is coupled to each respective one of the plurality of studs, and at least one of the filter assemblies comprising at least one discoidal capacitor. A resilient contact element electrically couples each the filter element to the respective terminal studs, and the contact element mechanically isolates the filter element from structural stress. A second housing coupled to the terminal block housing over the filter assemblies, and the filter assemblies are enclosed between the housings.

In another exemplary embodiment, a method for assembling a terminal block assembly is provided. The terminal block assembly includes a base assembly, a filter assembly, a ground plate and a cover assembly. The base assembly includes a terminal block housing having a terminal stud extending therethrough. The filter assembly includes a resilient contact element and a filter element, and the cover assembly includes a second housing and a fastener. The method comprises positioning the filter assembly over the terminal stud wherein the resilient contact element electrically contacts the stud, positioning the ground plate over the filter assembly;, electrically connecting the ground plate and the filter assembly. positioning the second housing over the filter element, and fastening the second housing to the terminal block housing such that the filter element is enclosed between the terminal block housing and the second housing.

DETAILED DESCRIPTION OF THE INVENTION

Figure 1:
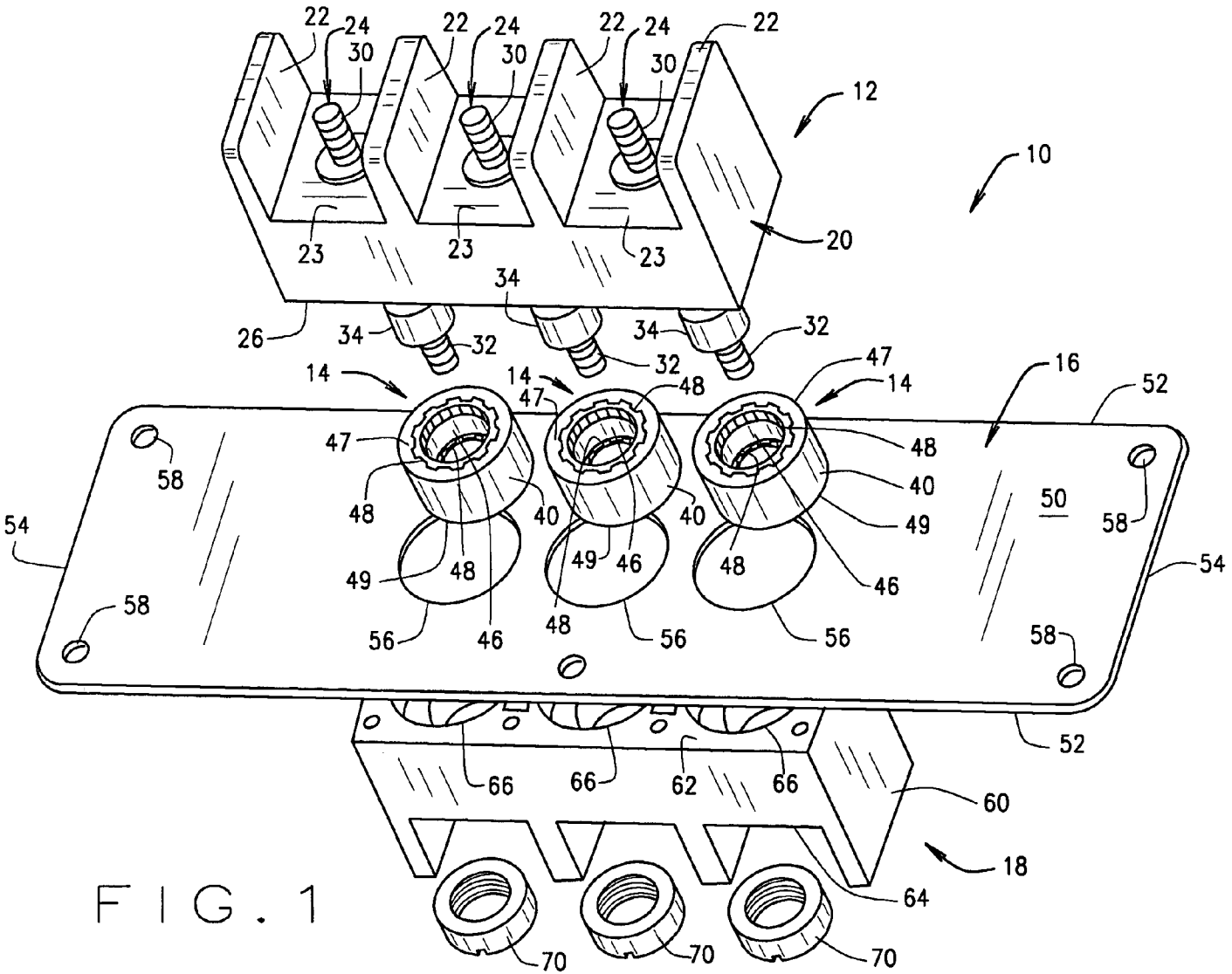
FIG. 1 is an exploded view of a terminal block assembly according to an exemplary embodiment of the invention.
Figure 2:
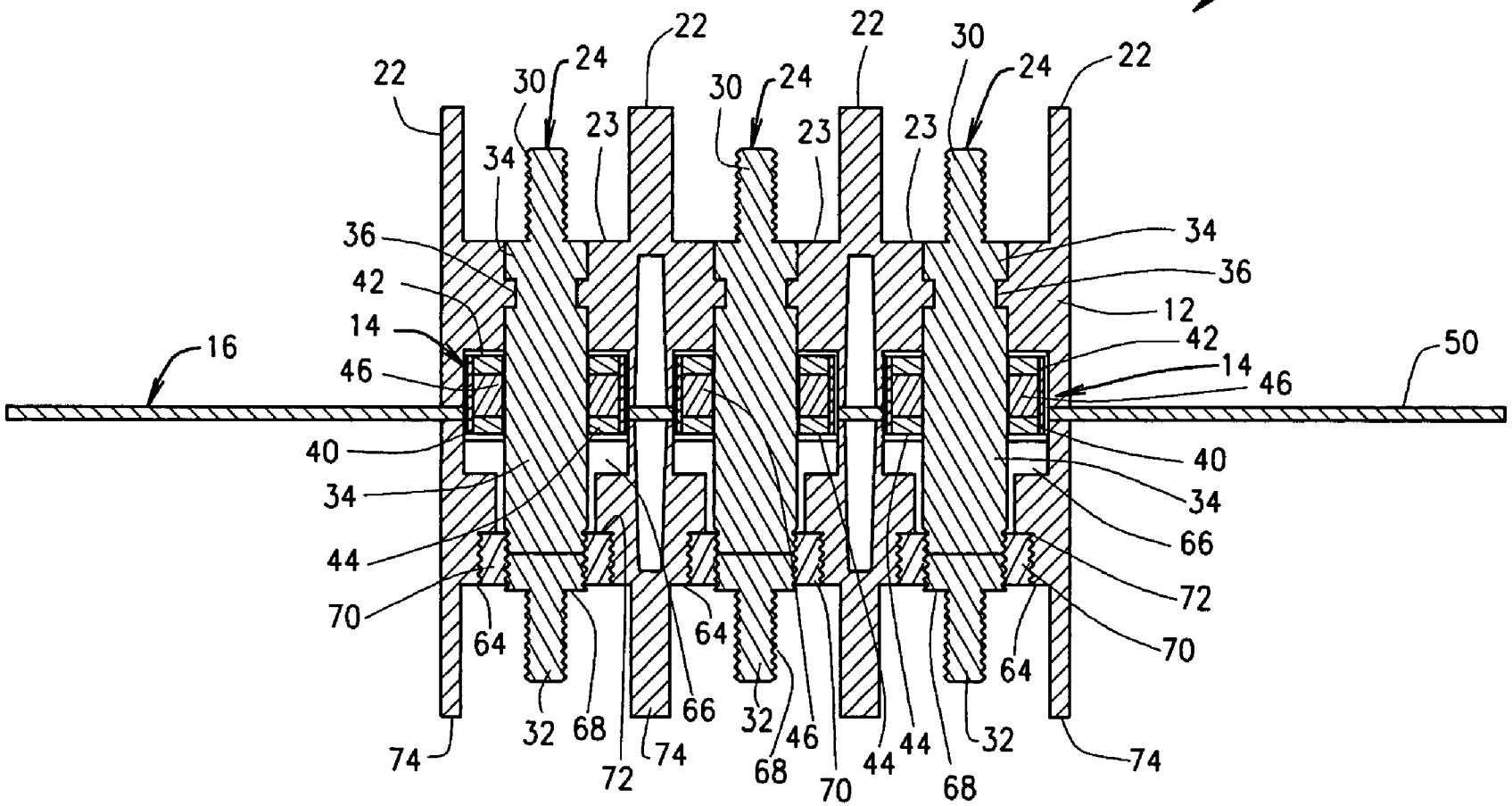
FIG. 2 is a cross sectional view of the terminal block assembly shown in FIG. 1 in an assembled state.

FIGS. 1 and 2 are an exploded assembly view and a cross sectional assembled view, respectively, of an exemplary terminal block assembly 10 for transmitting electrical signals from, for example, a power supply source, system or subsystem (not shown) to a power receiving component, system or subsystem (not shown) while filtering undesirable frequencies, electromagnetic interference and noise from the transmitted signal. While terminal block assembly 10 is particularly advantageous for use in connection with high current power supply systems for telecommunication systems, it is contemplated that the advantages of terminal block assembly also accrue to many other applications wherein signal distortion is problematic, including but not limited to telecommunication switching applications, cellular base stations, radar transmission systems, industrial control systems, and instrumentation systems. Therefore, the invention is not intended to be limited to any particular application, and the foregoing end-use applications are set forth for illustrative purposes only.

The terminal block assembly 10 includes a base assembly 12, a plurality of filter assemblies 14 coupled to the base assembly, a ground plate 16, and a cover assembly 18. The base assembly 10 includes a non-conductive terminal block housing 20 having upstanding partition walls 22 extending from a top surface 23 thereof. A plurality of electrically conductive terminal studs 24 extend through the housing 20 and extending from the housing 20 on the top surface 23 and a bottom surface 26 of the housing 20. In an exemplary embodiment, the terminal block housing 20 is fabricated from a known plastic or thermoplastic material, and the terminal studs 24 are insert molded therein to form the base assembly 12. In alternative embodiments, other dielectric materials are employed to fabricate terminal block housing 20, and the terminal studs 24 may be coupled to terminal block housing 20 according to other methods and techniques known to those in the art.

As is best seen in FIG. 2, the studs 24 each include opposite threaded ends 30 and 32, and a central body portion 34 extending from the threaded end 30 adjacent the top surface 23 and extending down through the terminal block housing 12. Unlike the threaded ends 30 and 32, the body portion 34 has a smooth outer surface, and the body portion 34 has a larger outer diameter than the threaded ends 30 and 32. An annular notch 36 is cut in the body portion 34 of the terminal studs 24, and the terminal block housing 20 includes annular ribs which engage the notches 36 of the studs 24 to secure the studs 24 in a predetermined position with respect to the terminal block housing 20. In an exemplary embodiment, the studs are located a center-to-center distance of about 1 inch from one another to achieve capacitance levels in the range of about 2 μF as further described below. It is understood that the center-to-center distance of the terminal studs 24 could be increased to achieve higher than about 2° F. of capacitance, or lesser center-to-center distances could be employed wherein lower capacitance levels are desired.

The partition walls 22 of the housing 20 extend in substantially parallel fashion from the top surface 23 and are approximately equally spaced from a longitudinal axis of the respective threaded end portions 30 of the terminal studs 24 which extend between the walls 22. Thus, compartments are formed between the partition walls 22 with one of the studs substantially centered in each compartment. Line-side or load-side devices (not shown) may be connected to the terminal studs 24 via the threaded ends 30 extending between the partition walls 22. The partition walls 22 avoid potential short circuiting of the line-side and load side devices as connections are made to the terminal studs 24. Connections may be made to the terminal studs 24 via, for example, known crimp wire terminals. While three terminals studs 24 are illustrated in the exemplary embodiment, it is appreciated that greater or fewer terminal studs 24 may be employed in alternative embodiments without departing from the scope of the present invention.

The filter assemblies 14 are each coupled to the body portion 34 of the studs 24 beneath the bottom surface 26 of the terminal block housing 20. In an exemplary embodiment, and as best illustrated in FIG. 2, each filter assembly 14 includes a metal sleeve 40 which houses a pair of discoidal capacitor elements 42 and 44 which are spaced from one another with a toroid element 46 extending between the capacitor elements 42 and 44. The discoidal capacitors 42 and 44, and the toroid 46 are known filtering components which collectively achieve capacitance levels of about 2 μF to filter signals passing through the terminal studs 24 between line side and load side circuitry and components.

Each of the capacitor elements 42 and 44, and the toroid 46 surround the body portion 34 of the respective terminal studs 24 and are maintained in a relative position with respect to one another by the metal sleeve 40. An elastic spring element 48 (FIG. 1) extends on each of the opposite ends 47, 49 of the filter assemblies 14, and the spring elements 48 include an annular ring having tabs extending outwardly and inwardly therefrom which contact the respective conductive terminations of the capacitor elements 42 and 44 and also establish electrical connection with the body portions 34 of the terminal studs 24. The spring elements 48 provide mechanically isolated connections to the capacitor elements 42 and 44 so that any torque or stress on the studs 24 during use of the terminal block assembly 10 is not transferred to the capacitor elements 42 and 44. By providing one spring element 48 on each of the opposite ends 47, 49 of the filter assemblies 14, torque or stress generated in either of the opposite threaded ends 30 and 32 of the terminal studs 24 does not adversely effect the performance or reliability of the filtering assemblies 14 or the components thereof.

While the exemplary capacitor elements 42 and 44 in the exemplary filter assemblies are discoidal capacitors, it is appreciated that other known filter elements, including but not limited to capacitive elements (e.g., tubular capacitors) and/or inductive elements may be used in further and/or alternative embodiments to achieve specified attenuation characteristics and capacitance levels for the terminal block assembly 10. It is appreciated that a variety of ratings of filter elements are commercially available from different manufacturers. Thus, a range of frequencies filtered from terminal block assembly 10 may be varied from application for different applications with proper selection of filter elements. The ratings of the filter assemblies 14 may be the same or different from one another to provide a variety of signal filtering options in the terminal block assembly 10.

The ground plate 16 in an exemplary embodiment is a generally rectangular shaped plate having a substantially planar surface 50 defined by longitudinal edges 52 and end edges 54. A plurality of filter openings 56 are provided in a central portion of the ground plate 16, and the filter openings 56 each receive one of the filter assemblies 14. The metal sleeves 40 of the filter assemblies 14 are electrically connected to the ground plate 16 with for example, solder or a conductive epoxy, which allows the sleeves 40 of the filter assemblies 14 to function as common ground contacts for the filter elements. The ground plate 16 includes mounting apertures 58 at the corners thereof for connection to, for example, a chassis ground of an electrical system. A conductive path to ground is therefore provided to dissipate filtered signals of the filter assemblies 14 coupled to the terminal studs 24.

While in the illustrated embodiment the ground plate 16 includes three filter openings 56 (i.e., one opening 56 for each filter assembly 14) greater numbers of filter openings 56 may be employed within the scope of the present invention to accommodate greater or fewer additional filter assemblies 14 in the terminal block assembly 10. That is, the ground plate 16, together with the terminal block housing 20, may be adapted for a desired end-use application with appropriate modification to greater or fewer numbers of terminal studs 24 and filter assemblies 14. It is also recognized that other shapes of the ground plate 16 may be used in alternative embodiments in lieu of the substantially rectangular ground plate 16 illustrated in the figures.

The cover assembly 18 includes an insulative (i.e., non-conductive) housing 60 having opposed surfaces 62 and 64. Bores 66 are formed in the housing 60 and extend from the surface 62 to the surface 64. A portion of the respective filter assemblies 14 are received in the bores 66, and the body portion 34 of the studs 24 extend through the bores 66 such that the filter assemblies are fully enclosed between the housing 60 of the cover assembly 18 and the terminal block housing 20 of the base assembly 12. The filter assemblies 14, unlike known filtered terminal blocks, are not exposed to adverse operating environments or inadvertent physical contact which could compromise the performance of the filtering components, but rather are fully protected by the housings 20 and 60. The ground plate 16 extends between the terminal block housing 20 and the housing 60, and the electrical connection of the metal sleeves 46 of the filter assemblies 14 is enclosed by the housings 20 and 60 to provide a secure ground path for the filter assemblies 14.

The main body 34 of each terminal stud 24 includes a threaded lower portion 68 which extends adjacent the lower surface 64 of the housing 60. The threaded lower portion 58 of the terminal studs 24 has a larger diameter than the threaded ends 32 of the terminal studs, and fasteners 70 are secured to the threaded portions 68 of the terminal studs 24 while leaving the threaded ends 32 exposed from the housing 60. In an illustrative embodiment, the fasteners 70 are threaded nuts, which securely engage the threaded portions 68 of the terminal studs 24. Shoulders 72 are provided in the housing 60 which the fasteners 70 abut when tightened to secure the housing 60 to the terminal block housing 12 with the filter assemblies 14 therebetween.

Like the terminal block housing 12, the housing 60 of the cover assembly 18 includes partition walls 74 which extend parallel to one another, and the walls 74 define compartments extending about and separating the threaded ends 32 of the terminal studs 24 from one another. The threaded ends 32 of the terminal studs may therefore be coupled to line-side or load-side circuitry and equipment via for, example, crimp wire terminals, without risk of short circuiting the connections of the line-side and load-side equipment.

The terminal block assembly 10 may be manufactured and assembled as described as follows. The base assembly is pre-formed with the terminal studs 24 molded in the terminal block housing 20. Filter assemblies 14 are separately assembled with the discoidal capacitors 42, 44 and the toroid 46 in the metal sleeve 40 and the spring contact elements 48 coupled to the terminations of the capacitor elements 42 and 44. The filter assemblies 14 are then pressed onto the body portions 34 of the terminal studs 24 to electrically connect the filter elements to the studs 24. The ground plate 16 is then placed over the filter assemblies 14 and the metal sleeves 40 of the filter assemblies 14 are electrically connected to the ground plate 16 with for example, a solder operation or a conductive epoxy. The housing 60 of the cover assembly 18 is then inserted over the filter assemblies 14 to enclose the filter assemblies 14 between the housing 18 and the terminal block housing 2. The fasteners 70 are coupled to the threaded portions 68 of the terminal studs 24 and tightened to secure the housings 20 and 60 together, thereby maintaining all the components thereof in position with respect to one another and completing the assembly 10.

The resilient contact elements 48 mechanically isolate the filter assemblies 14 from mechanical loads and associated mechanical stress that may occur, for example, when wires (not shown) are connected to the threaded ends 30 and 32 of the terminal studs 24. The resilient contact elements 48 absorb structural loads-that would otherwise be placed on filter elements 14. Negative impacts on filter performance due to structural stress and strain on the filter assemblies 14 are therefore avoided.

When an electrical circuit is completed through terminal studs 24, predetermined frequency ranges of signals passing therethrough are filtered out by filter assemblies 14. Thus, for example, a clean power supply signal, i.e., free of undesirable noise, may be supplied to, for example, telecommunications system equipment.

A terminal block assembly 10 is therefore provided in which high capacitance levels of about 2 μF may be achieved in an economical manner. The terminal block 10 may be manufactured at lower cost than known terminal blocks providing comparable performance.

While the invention has been described in terms of various specific embodiments, those skilled in the art will recognize that the invention can be practiced with modification within the spirit and scope of the claims.

What is claimed is:

1. A terminal block assembly comprising:

a base assembly comprising a terminal block housing and a terminal stud extending through said terminal block housing;

a filter assembly coupled to one end of said stud;

a second housing coupled to said terminal block housing over said filter assembly, said second housing receiving a portion of said filter assembly and enclosing said filter assembly between said first and second housing, an end of the terminal stud being exposed through said second housing, and said second housing comprising opposing side walls, opposing end walls interconnecting the opposing side walls, and a partition wall extending transversely to the opposing side walls and spaced from the end walls, the partition wall extending about the exposed end of said terminal stud; and a ground plate coupled to said base assembly and said filter assembly for dissipating filtered signals.

2. A terminal block assembly in accordance with claim 1 further comprising at least one resilient contact element coupling said terminal stud and said filter assembly so as to mechanically isolate said filter element from said terminal stud to prevent structural loading of said filter assembly.

3. A terminal block assembly in accordance with claim 2 wherein said resilient contact element comprises an annular ring having tabs extending outwardly and inwardly from said ring.

4. A terminal block assembly in accordance with claim 1 wherein said filter assembly comprises at least one discoidal capacitor.

5. A terminal block assembly in accordance with claim 1 wherein said filter assembly comprises at least one capacitor and at least one toroid.

6. A terminal block assembly in accordance with claim 1 wherein said filter assembly comprises a metal sleeve, said sleeve electrically connected to said ground plate.

7. A terminal block assembly in accordance with claim 1 wherein said terminal stud comprises threaded ends and a body portion therebetween, an end of said body portion being threaded adjacent one of said threaded ends, said assembly further comprising a nut coupled to said body portion, said nut coupling said second housing to said terminal block housing while leaving said one threaded end exposed from said block.

8. A terminal block assembly comprising:

a terminal block housing comprising a body and an upstanding partition wall extending from said body;

first and second terminal studs extending through said body of said terminal block housing, an end of each the first and second terminal studs being separated from one another by said partition wall;

a first filter assembly coupled to said first stud and a second filter assembly coupled to said second stud, each of said first and second filter assemblies comprising at least two filtering elements, at least one of said filtering elements being a discoidal capacitor; and each of said first and second filter assemblies further comprising at least two resilient contact elements, each of the at least two filtering elements being electrically coupled to one of said filter elements and to one of the first and second terminal studs, said contact elements mechanically isolating said filtering element from structural stress.

9. A terminal block assembly in accordance with claim 8 further comprising a second housing coupled to said terminal block housing, said terminal block housing and said second housing enclosing said filter assembly.

10. A terminal block in accordance with claim 8 wherein said filter assembly comprises a pair of discoidal capacitors separated by a toroid.

11. A terminal block assembly in accordance with claim 8 further comprising a ground plate, said filter assembly comprising a conductive sleeve electrically connected to said ground plate.

12. A terminal block assembly in accordance with claim 8 further comprising a second housing coupled to said terminal block housing, said second housing fastened to said first housing with said filter assembly therebetween.

13. A terminal block assembly in accordance with claim 8 wherein said terminal block assembly has a capacitance of about 2 μF.

14. A terminal block assembly comprising:

a terminal block housing comprising a plurality of upstanding partition walls spaced from one another;

a plurality of terminal studs extending through said terminal block housing, each of said plurality of terminal studs having an exposed distal end extending generally parallel to at least one of said partition walls, and wherein respective distal ends of the plurality of terminal studs are separated by at least one of said partition walls;

a filter assembly coupled to each respective one of said plurality of studs, at least one of said filter assemblies comprising at least one discoidal capacitor;

a resilient contact element electrically coupling each said filter element to the respective terminal studs, said contact element mechanically isolating said filter element from structural stress; and a second housing coupled to said terminal block housing over said filter assemblies, said filter assemblies enclosed between said terminal block housing and said second housing.

15. A terminal block in accordance with claim 14 wherein at least one of said filter assemblies comprises a pair of discoidal capacitors separated by a toroid.

16. A terminal block assembly in accordance with claim 14 further comprising a ground plate extending between said terminal block housing and said second housing, said filter assembly comprising a conductive sleeve electrically connected to said ground plate.

17. A terminal block assembly in accordance with claim 14 wherein said terminal block assembly has a capacitance of about 2 μF.

18. A method for assembling a terminal block assembly including a base assembly, a filter assembly, a ground plate and a cover assembly; the base assembly including a terminal block housing having a terminal stud extending therethrough and at least one partition wall extending adjacent the stud; the filter assembly including a resilient contact element and a filter element; and the cover assembly including a fastener and second housing having at least one partition wall defining a compartment for the terminal stud, said method comprising:

positioning the filter assembly over the terminal stud wherein the resilient contact element electrically contacts the stud;

positioning the ground plate over the filter assembly;

electrically connecting the ground plate and the filter assembly;

positioning the second housing over the filter element; and fastening the second housing to the terminal block housing such that the filter element is enclosed between the terminal block housing and the second housing and the partition wall of the second housing extends generally about an exposed end of a portion of the terminal stud which is exposed from the second housing.

19. A method in accordance with claim 18 wherein said fastening the second housing comprises:

fastening a nut to the portion of the terminal stud which is exposed from the second housing; and tightening the nut to the terminal stud until the second housing is securely coupled to said first housing with the filter assembly enclosed therebetween.

20. A method in accordance with claim 18 wherein said electrically connecting the ground plate and the filter assembly comprises electrically connecting a metal sleeve of the filter assembly to the ground plate.

21. A method in accordance with claim 18 further comprising assembling the filter assembly with a metal sleeve, a pair of discoidal capacitors in the sleeve, a toroid separating the discoidal capacitors within the sleeve, and a resilient contact element at each end of the metal sleeve, each said resilient contact element configured to establish electrical connection with one of the discoidal capacitors.

22. A method in accordance with claim 18 further comprising repeating the steps of claim 18 to form a multiple pole terminal block having a plurality of terminal studs, each of the studs having one filter assembly coupled thereto, wherein the terminal block has a capacitance of about 2 μF.

* * * * *